US005713754A

United States Patent [19]

Samejima et al.

[11] Patent Number: 5,713,754

[45] Date of Patent: Feb. 3, 1998

[54] FITTING STRUCTURE OF MOVABLE CONNECTOR

[75] Inventors: Masakuni Samejima; Hideto Kumakura, both of Shizuoka, Japan

[73] Assignee: Yazaki Corporation, Tokyo, Japan

[21] Appl. No.: 719,632

[22] Filed: Sep. 25, 1996

[30] Foreign Application Priority Data

Sep. 28, 1995 [JP] Japan ..... 7-251063

[51] Int. Cl.[6] ..... H01R 13/629

[52] U.S. Cl. ..... 439/374

[58] Field of Search ..... 439/374, 375

[56] References Cited

U.S. PATENT DOCUMENTS 5,161,996 11/1992 Locati ..... 439/374

FOREIGN PATENT DOCUMENTS 186774 7/1989 Japan ..... 439/375

5-50610 7/1993 Japan .

998488 7/1965 United Kingdom .

*Primary Examiner*—Gary F. Paumen

*Attorney, Agent, or Firm*—Sughrue, Mion, Zinn, MacPeak & Seas, PLLC

[57] ABSTRACT

A movable connector includes guide projections projecting on the opposite side faces of a housing of the movable connector, tapered faces formed on the top ends of the guide projections, a pair of side guide plates provided on fitting faces of a fitting-paired-side connector so as to project therefrom, a front guide plate provided on the fitting faces of the fitting-paired-side connector so as to project therefrom, spaces formed in corner portions between the side guide plates and the front guide plate so that the guide projections are inserted into the spaces, and guide faces formed on the top ends of the side guide plates so as to be inclined toward the spaces to come into contact with the tapered faces of the guide projections.

7 Claims, 9 Drawing Sheets

FITTING STRUCTURE OF MOVABLE CONNECTOR

BACKGROUND OF THE INVENTION

1. Field of the Invention

The present invention relates to a fitting structure of a movable connector for absorbing relative positional misregistration between connectors by a movement when the connectors are fitted to each other, and particularly to an improvement in mutual guide operation at the time of start of the movement for absorbing the positional misregistration.

2. Background

Various parts which need to be supplied with electric power are attached to a vehicle. For example, in a conventional room lamp, a lamp 9 is attached in such a manner that an electric wire 5 provided in a space between an outside plate 1 and a vehicle ceiling 3 is connected to the lamp 9 through a connector 7, and the lamp 9 with the electric wire 5 connected thereto is inserted into a fitting hole 11 formed in the ceiling 3, and fixed by a screw onto a roof bow 13 which is fixed to the outside plate 1, as shown in FIG. 11.

In such a fitting structure, however, the electric wire 5 is often nipped between an edge portion of the fitting hole 11 and the lamp 9 when the lamp 9 is attached into the fitting hole 11. In addition, it is necessary to attach the lamp 9 into the fitting hole 11 after the electric wire 5 is taken out of the fitting hole 11 and is connected to the lamp 9 so that the number of operations increases, and it is necessary to insert the lamp 9 into the fitting hole 11 while the electric wire 5 is pushed into the fitting hole 11, therefore, the workability is poor.

In order to solve the above problems, there has been proposed a structure in which a vehicle-body-side connector 15 with an electric wire 5 connected thereto is provided in a roof bow 13, and a lamp-side connector 17 which is fittable to the vehicle-body-side connector 15 is provided on the lamp 9, so that electric connection is completed at the same time when the lamp is attached, as shown in FIG. 12. In such a structure, in order to absorb relative positional misregistration between the two connectors 15 and 17, for example, it is necessary to fit the vehicle-body-side connector 15 to the lamp-side connector 17 while making the former follow the position of the latter when the lamp 9 is attached.

In order to solve the above problems, further, there has been proposed a movable connector for absorbing positional misregistration by its own movability when a lamp is attached. For example, Unexamined Japanese Utility Model Publication No. Hei. 5-50610 which discloses such a movable connector as shown in FIG. 13. FIG. 13 is a side view illustrating such a conventional movable connector, and FIG. 14 is an exploded perspective view of the movable connector of FIG. 13. In this conventional example, a movable connector 25 is fixed into a fitting hole 23 formed in a vehicle body panel 21, and a lamp-side connector 27 and the movable connector 25 are connected to each other through a sub-connector 30 formed in an L-shape.

In this movable connector 25, elastic lock members 29 are provided in opposite sides of a rectangular connector housing, and lock portions of the respective elastic lock members 29 are engaged with circumferential edge portions of the fitting hole 23, so that the movable connector 25 is held on the vehicle panel 21.

The movable connector 25 is held in the fitting hole 23 through the elastic lock members 29. Accordingly, the movable connector 25 is allowed to move slightly by the elastic transformation of the elastic lock members 29 to thereby absorb relative positional misregistration between the movable connector 25 and the sub-connector 30.

In the above-mentioned fitting structure of the movable connector 25, the movable connector is movable through the elastic lock members 29 in order to absorb the positional misregistration. Since the top end portions of the movable connector 25 and the sub-connector 30 are formed as box-like hood portions 25*a* and 30*a* respectively, the parallel edge portions of the hood portions 25*a* and 30*a* come into contact with each other simply at the beginning of the contact of the two connectors with positional misregistration, and the structure fails to have a function to guide the two connectors in the direction of absorbing the positional misregistration effectively. That is, if the edge portions of the hood portions 25*a* and 30*a* contact with each other at the beginning of the contact of the two connectors, there may be a case where the two connectors move relatively in the direction opposite to the direction of absorbing the positional misregistration. Therefore, the reliability of a function for absorbing the positional misregistration goes down.

SUMMARY OF THE INVENTION

The present invention has been made to overcome the above problem, and an object of the invention is to provide a fitting structure of a movable connector which can guide two connectors in the direction of absorbing a positional misregistration therebetween at the beginning of the contact of the connectors to thereby improve the reliability in the positional misregistration absorbing function in the movable connector.

In order to achieve the above object, according to an aspect of the present invention, a fitting structure between a fitting-paired-side connector and a movable connector movably attached to a fitting member in order to absorb a positional misregistration relative to the fitting-paired-side connector, which includes guide projections provided on opposite sides of a housing of the movable connector so as to project therefrom so that the guide projections extend in a fitting direction of the connectors and top ends thereof project over a fitting surface of the movable connector, tapered faces formed on the respective guide projections to taper off the top ends, a pair of parallel side guide plates provided on a fitting surface of the fitting-paired-side connector so as to project therefrom so that the side guide plates hold, by their opposite faces, the opposite sides of the housing, the side guide plates being made to be elastically displaceable in a direction of its front-to-back side, a front guide plate provided on the fitting surface of the fitting-paired-side connector so as to project perpendicularly to the side guide plates, the front guide plate being divided, at its top end side, into at least three portions by slits cut in a projecting direction of the front guide plate so that the front guide plate contacts with other side faces perpendicular to the opposite sides of the housing connected by the side guide plates, the front guide plate being made to be elastically displaceable in a direction of its front-to-back side, a space formed in the connector fitting direction at a corner portion between the side guide plates and the front guide plate perpendicular to the guide plates so that the guide projections of the movable connector are inserted into the space, and guide faces formed on top ends of the side guide plates so as to be inclined toward the space to contact with the tapered faces of the guide projections.

Thus, in the fitting structure of a movable connector, when the fitting-paired-side connector having the positional misregistration is inserted onto the movable connector, the fitting-paired-side connector is guided by sliding between the guide faces of the side guide plates and the tapered faces of the guide projections, or between the front guide plate and the tapered faces of the guide projections, or between the top ends of the side guide plates and the tapered faces of the guide projections, so that the fitting-paired-side connector is fitted to the movable connector in a predetermined position.

DETAILED DESCRIPTION OF THE PREFERRED EMBODIMENT

Preferred embodiments of a fitting structure of a movable connector according to the present invention will be described in detail with reference to the drawings.

Figure 1:
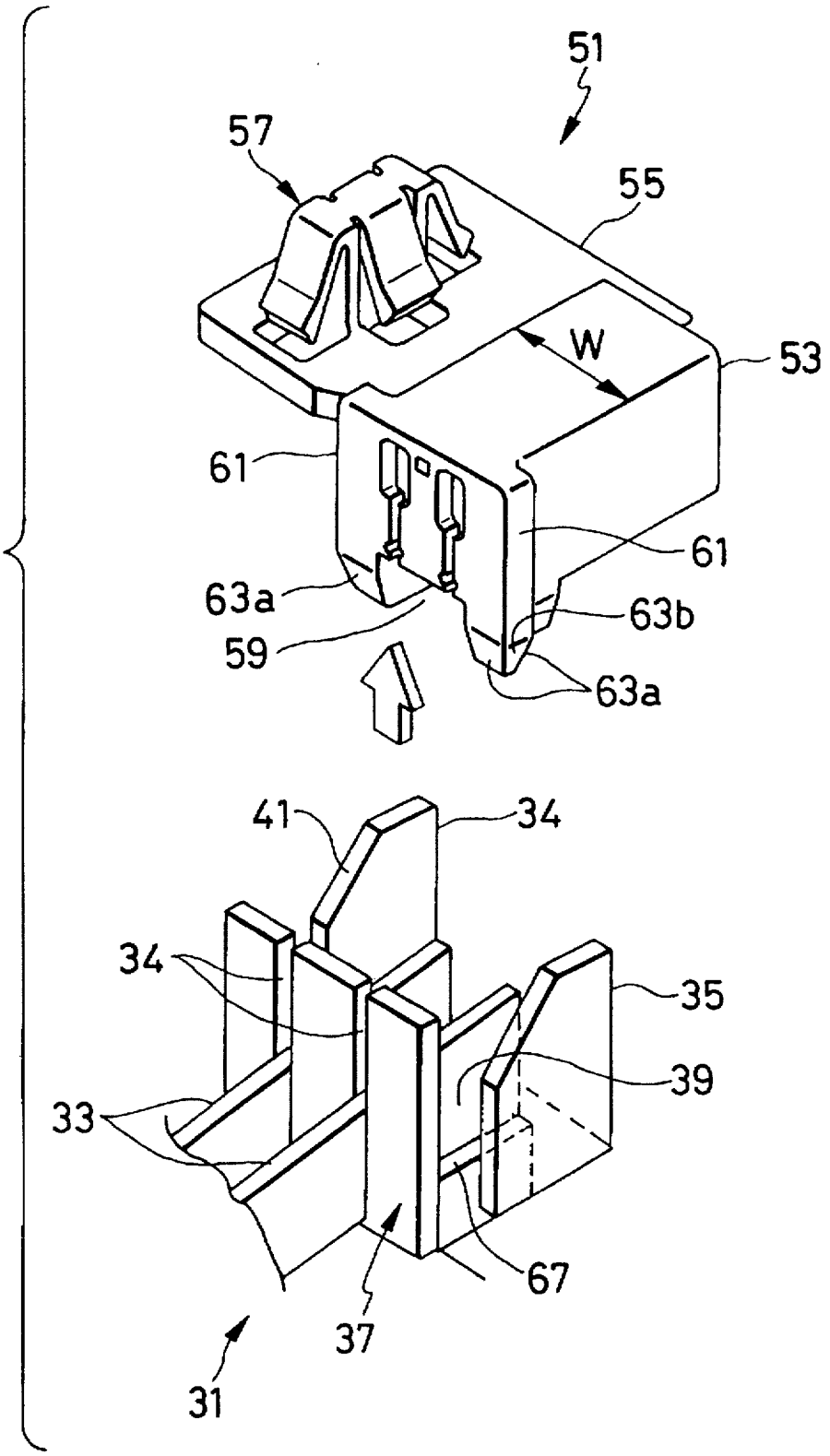
FIG. 1 is an exploded perspective view illustrating a fitting structure according to the present invention, before a movable connector and a fitting-paired-side connector are fitted to each other.
Figure 2:
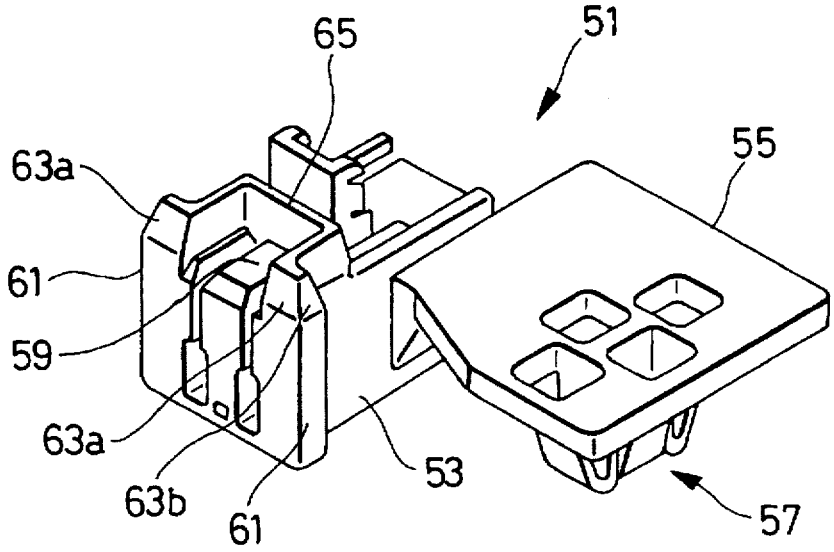
FIG. 2 is a perspective view of the movable connector in FIG. 1, viewed from the fitting face side.

FIG. 1 is an exploded perspective view illustrating a fitting structure according to the present invention in a state where a movable connector and a fitting-paired-side connector have not yet been fitted to each other, and FIG. 2 is a perspective view of the movable connector of FIG. 1 viewed from the fitting surface side.

A pair of parallel knife-edge-type male terminals 33 are provided in a fitting-paired-side connector 31. Outside the male terminals 33, a pair of side guide plates 35 corresponding to a housing of the fitting-paired-side connector 31 are provided in parallel with the male terminals 33 so as to hold the male terminals 33 therebetween. Each of the male terminals 33 is shaped like a band plate. The side guide plates 35 are provided so as to stand in the direction perpendicular to the longitudinal direction of the male terminals 33 at the top end sides of the male terminals 33. In the fitting-paired-side connector 31, the standing direction of these side guide plates 35 become the direction of fitting between the fitting-paired-side connector and a movable connector which will be described later. The side guide plates 35 are molded with resin material, so that their top end sides are elastically displaceable on their front-to-back side, that is, in the direction where they are close to and separated from each other.

In the fitting-paired-side connector 31, a front guide plate 37 is provided so as to be coupled with the side guide plates 35, the front guide plate 37 being disposed perpendicularly to the male terminals 33. In order to make the front guide plate 37 perpendicular to the pair of the parallel male terminals 33, the front guide plate 37 is divided into three small plate portions by slits 34, the three small plate portions standing in the same direction as the side guides 35. Since the front guide plate 37 is molded with resin material, they are displaceable elastically at their top end sides in the direction of their front-to-back sides independently of each other.

Therefore, the front guide plate 37 is disposed so as to be perpendicular to the side guide plates 35 so that the top end sides of the male terminals 33 are enclosed substantially in a U-shape by the front guide plate 37 and the side guide plates 35. A corner portion where the side guide plate 35 and each front guide plate 37 are made perpendicular to each other becomes a space 39, so that the side guide plate 35 and the front guide plate 37 are opposite to each other through the space 39. A guide projection of a movable connector which will be described later is to be fitted into this space 39. In addition, a guide face 41 is formed on the top end of each side guide plate 35, the guide face 41 being inclined to provide a down gradient from the top of the side guide plate 35 toward the space 39.

On the other hand, a movable connector 51 which is inserted into the fitting-paired-side connector 31, the movable connector 51 includes a housing 53 in which a female terminal (not-shown) is accommodated, a support plate 55 coupled with this housing 53, and a lock portion 57 provided on this support plate 55 so as to project therefrom. By locking the lock portion 57 into a fitting hole of a fitting member (not shown), the housing 53 of the movable connector 51 is movably attached to the fitting member. That is, the movable connector 51 absorbs the positional misregistration relative to the fitting-paired-side connector 31 through this movability.

The housing 53 is formed into an approximately rectangular shape, and one face thereof is made to act as a fitting face 59 (see FIG. 2). The housing 53 is fitted into the fitting-paired-side connector 31 while this fitting face 59 is made opposite to the male terminals 33 as shown in FIG. 1. Therefore, the housing 53 is fitted into a fitting space enclosed by the side guide plates 35 and the front guide plate 37 which are disposed substantially in a U-shape.

Rail-like guide projections 61 which are elongated in the connector fitting direction are provided on the opposite side faces of the housing 53 so as to face the pair of side guide plates 35 respectively. The guide projections 61 are fitted into the spaces 39 of the fitting-paired-side connector 31 when the fitting-paired-side connector 31 is inserted onto the housing 53. Tapered faces 63*a* are formed at the respective lower ends of the guide projections 61 in the drawing, that is, on the respective top ends of the guide projections 61 in the fitting direction in a manner so that the respective top ends of the guide projections 61 in the fitting direction are gradually tapered off so as to be narrowed in their widthwise direction. Further, tapered faces 63*b* are formed on the respective top ends of the guide projections 61 in the fitting direction in a manner so that the respective top ends of the guide projections 61 in the fitting direction are gradually tapered off so as to be narrowed in the direction of width w (see FIG. 1) of the housing 53.

The guide projections 61 are formed to project over the fitting face 59 of the housing 53 as shown in FIG. 2. A U-shaped wall-like rib 65 is provided to project from the fitting face 59 of the housing 53, and the opposite ends of the rib 65 are connected to the guide projections 61 respectively. The rib 65 projects in the same height as the guide projections 61. Since the rib 65 projects in the same height as the guide projections 61, the top end faces of the rib 65 and the guide projections 61 are continuous in one and the same plane.

The operation of the thus configured fitting structure will be described.

Figure 3A:
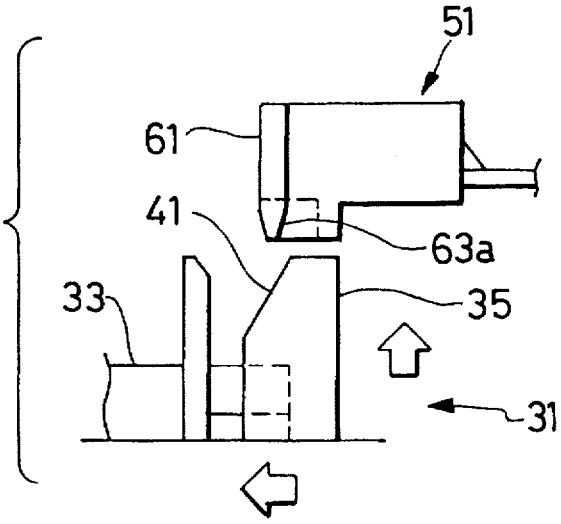
FIGS. 3A and 3B are explanatory views illustrating a guide state where the fitting-paired-side connector has a positional misregistration relative to the movable connector toward the base end side of male terminals in a plane perpendicular to the fitting direction.
Figure 3B:
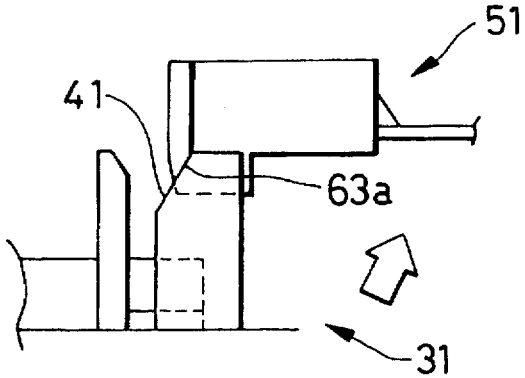
Figure 4:
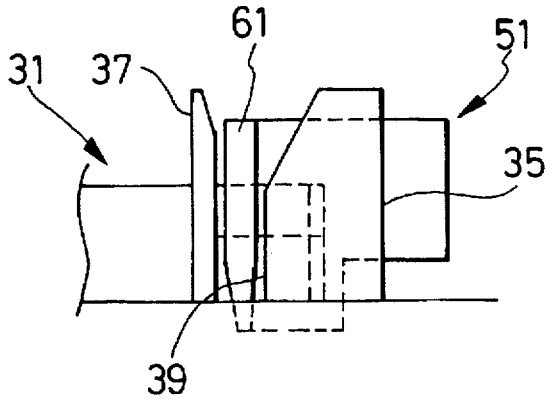
FIG. 4 is a side view of the movable connector and the fitting-paired-side connector which have been fitted normally.

FIGS. 3A and 3B are explanatory views illustrating a guide state where the fitting-paired-side connector is misregistered toward the base end side of the male terminals in a plane perpendicular to the fitting direction relatively to the movable connector, and FIG. 4 is a side view of the movable connector and the fitting-paired-side connector which have been fitted normally.

When the fitting-paired-side connector 31 with a positional misregistration toward the base end side of the male terminals 33 in a plane perpendicular to the fitting direction is inserted onto the movable connector 51, first, the guide faces 41 formed on the respective top ends of the side guide plates 35 of the fitting-paired-side connector 31 contact with the tapered faces 63*a* on the respective top ends of the guide projections 61 of the movable connector 51.

In this state, when the fitting-paired-side connector 31 is further inserted, the fitting-paired-side connector 31 is guided by the sliding of the guide faces 41 and the tapered faces 63*a* so as to make the spaces 39 fit to the guide projections 61. In the two connectors in which the guide projections 61 and the spaces 39 are fitted to each other, the fitting face 59 of the housing 53 contacts with fitting faces 67 (see FIG. 1) of the fitting-paired-side connector 31 so that the two connectors 31 and 51 are fitted in a predetermined position surely as shown in FIG. 4.

Figure 5A:
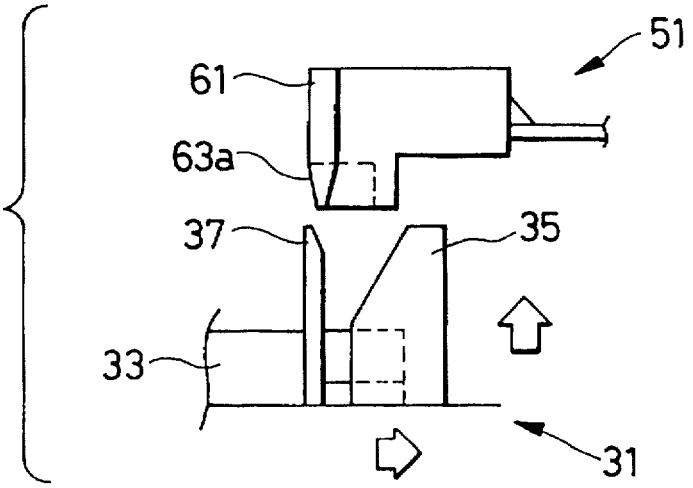
FIGS. 5A and 5B are explanatory views illustrating a guide state where the fitting-paired-side connector has a positional misregistration relative to the movable connector toward the top end side of the male terminals in a plane perpendicular to the fitting direction.
Figure 5B:
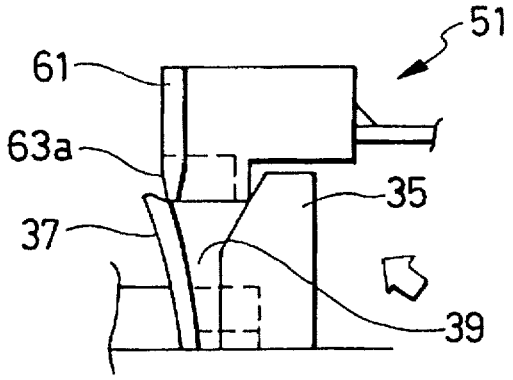

FIGS. 5A and 5B are explanatory views illustrating a guide state in the case where the fitting-paired-side connector has a positional misregistration relative to a movable connector toward the top end side of male terminals in a plane perpendicular to the fitting direction.

When the fitting-paired-side connector 31 having a positional misregistration toward the top end side of the male terminals 33 in a plane perpendicular to the fitting direction is inserted onto the movable connector 51, first, the front guide plate 37 contacts with the tapered faces 63*a* of the guide projections 61 of the movable connector 51. The top end side of the front guide plate 37 is moved to the outside of the guide projections 61 by elastic displacement so as to expand the fitting opening, and guide the guide projections 61 into the spaces 39.

In this state, when the fitting-paired-side connector 31 is further inserted, the fitting-paired-side connector 31 is guided by the sliding of the front guide plate 37 and the tapered faces 63*a* so as to make the guide projections 61 fit into the spaces 39 so that the two connectors 31 and 51 are fitted to each other in a predetermined position surely as shown in FIG. 4.

At this time, since the front guide plate 37 is displaced elastically, remaining power (excessive load) when the fitting-paired-side connector 31 is pushed in is absorbed so that the connectors, an apparatus unit to which the fitting-paired-side connector 31 is fixed, or the like, can be prevented from being injured.

Figure 6A:
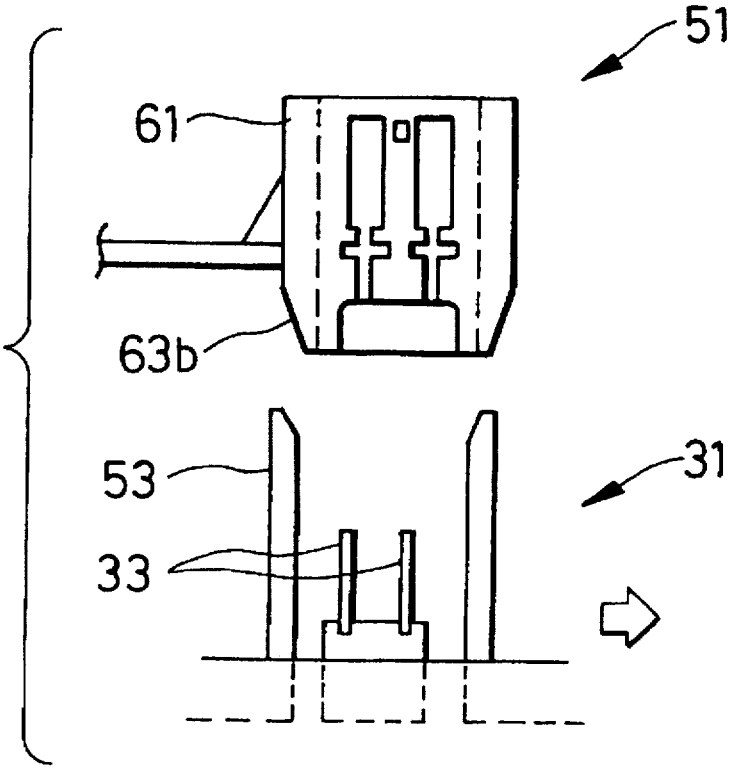
FIGS. 6A and 6B are explanatory views illustrating a guide state where the fitting-paired-side connector has a positional misregistration relative to the movable connector in the direction perpendicular to the longitudinal direction of the male terminals in a plane perpendicular to the fitting direction.
Figure 6B:
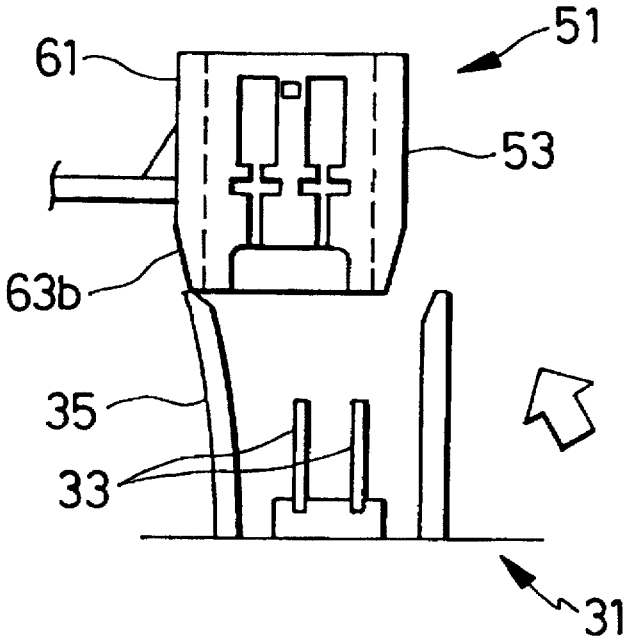
Figure 7:
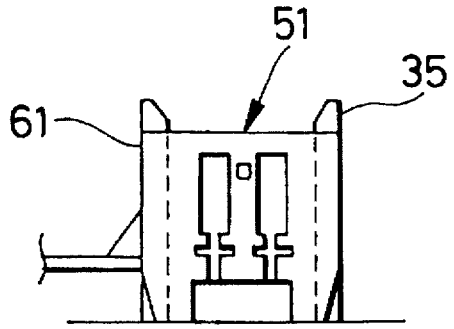
FIG. 7 is a front view of the movable connector and the fitting-paired-side connector which have been fitted normally.

FIGS. 6A and 6B are explanatory views illustrating a guide state where the fitting-paired-side connector has a positional misregistration relative to a movable connector in the direction perpendicular to the longitudinal direction of the male terminals in a plane perpendicular to the fitting direction, and FIG. 7 is a front view of the movable connector and the fitting-paired-side connector which have been fitted normally.

When the fitting-paired-side connector 31 having a positional misregistration in the direction perpendicular to the longitudinal direction of the male terminals 33 in a plane perpendicular to the fitting direction is inserted onto the movable connector 51, first, the top ends of the side guide plates 35 contact with the tapered faces 63*b* of the guide projections 61 of the movable connector 51. The top end sides of the side guide plates 35 are moved to the outside of the guide projections 61 by elastic displacement so as to expand the fitting opening, and guide the guide projections 61 into the fitting space between the pair of side guide plates 35.

In this state, when the fitting-paired-side connector 31 is further inserted, the fitting-paired-side connector 31 is guided by the sliding of the side guide plates 35 and the tapered faces 63*b* so as to make the housing 53 fit into between the side guide plates 35 so that the two connectors 51 and 31 are fitted to each other in a predetermined position as shown in FIG. 7.

Next, the operation in fitting by the provision of the rib 65 on the tops of the guide projections 61 will be described with reference to FIGS. 8A to 10C.

Figure 8A:
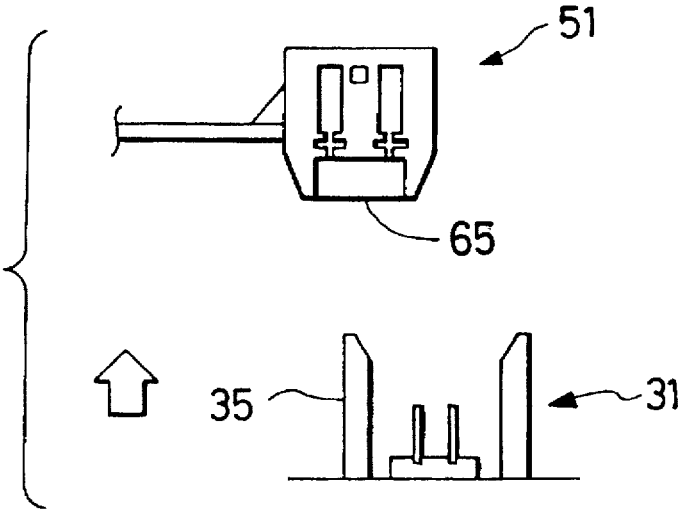
FIGS. 8A and 8B are explanatory views illustrating a guide state where the fitting-paired-side connector has a positional misregistration relative to the movable connector on a rib in a plane perpendicular to the fitting direction.
Figure 8B:
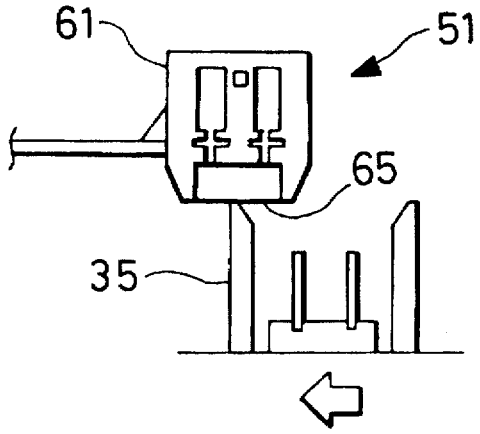
Figure 9:
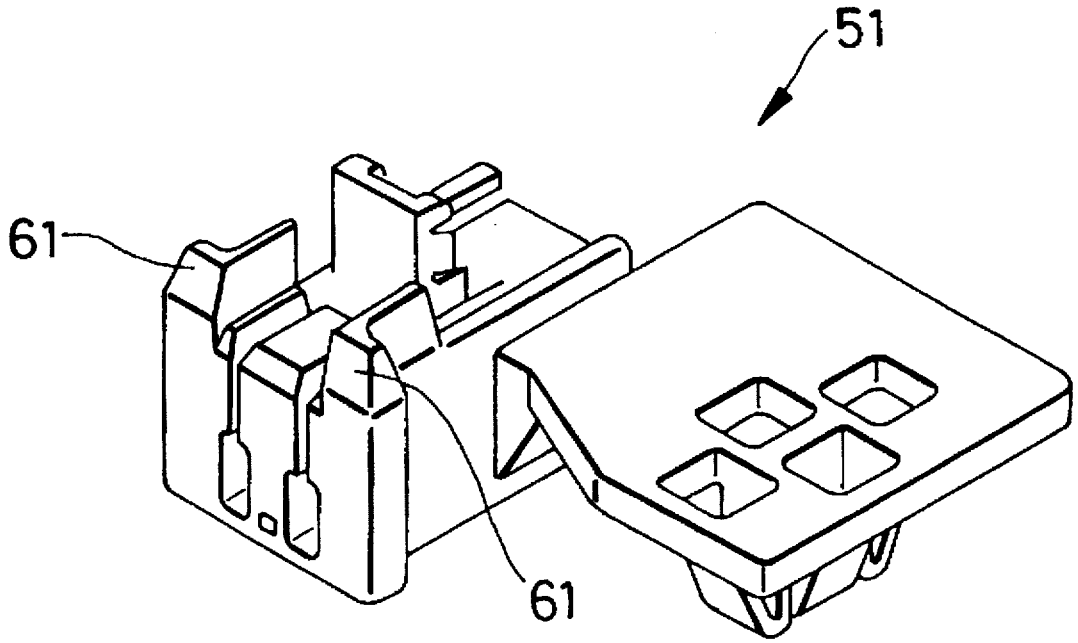
FIG. 9 is a perspective view illustrating a movable connector in which no rib is formed.
Figure 10A:
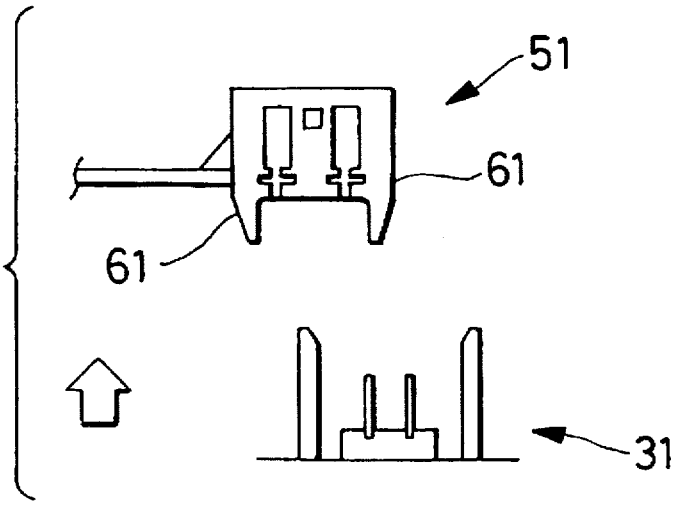
FIGS. 10A, 10B and 10C are explanatory views illustrating a state where the movable connector having no rib has been fitted.
Figure 10B:
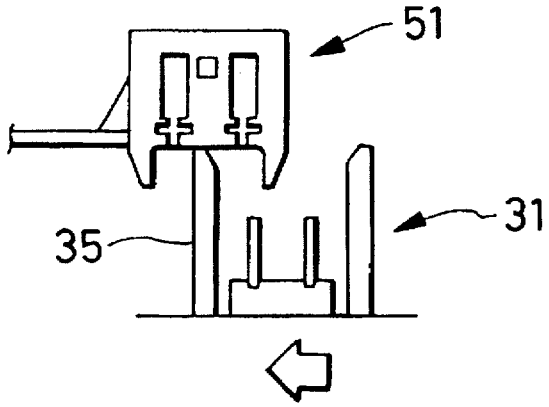
Figure 10C:
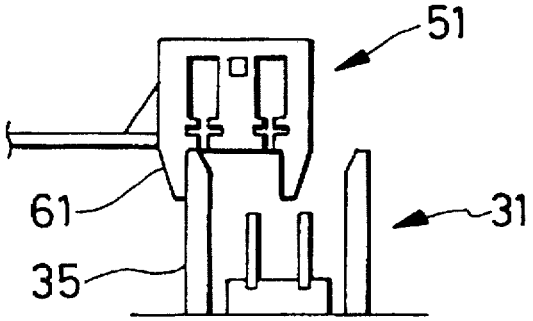
Figure 11:
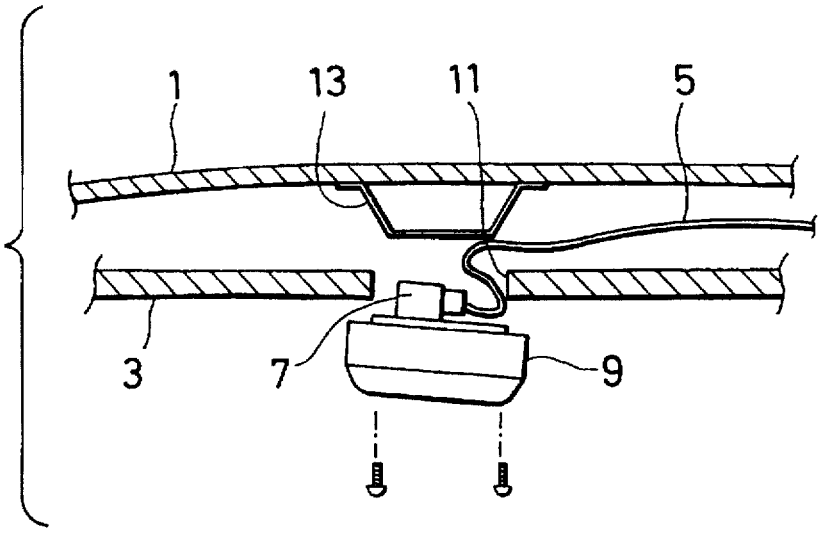
FIG. 11 PRIOR ART
FIG. 11 is a sectional view illustrating a conventional fitting structure of a room lamp.
Figure 12:
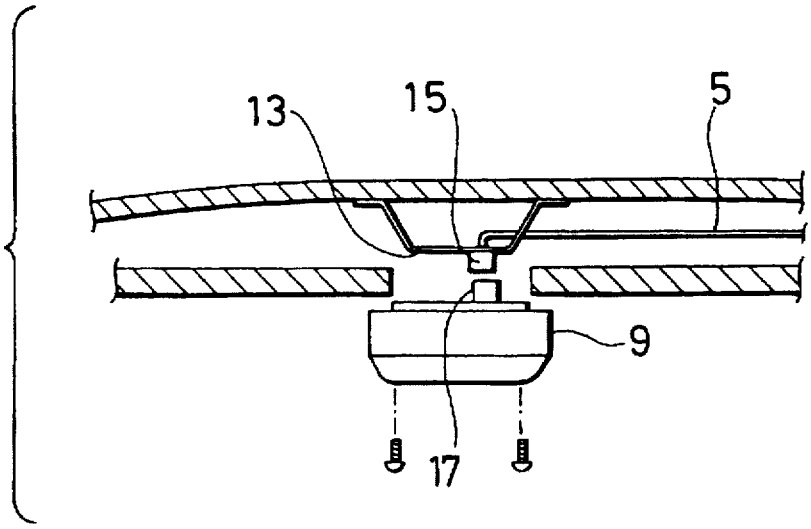
FIG. 12 PRIOR ART
FIG. 12 is a sectional view illustrating a conventional fitting structure of a room lamp where a connector connection system is adopted.
Figure 13:
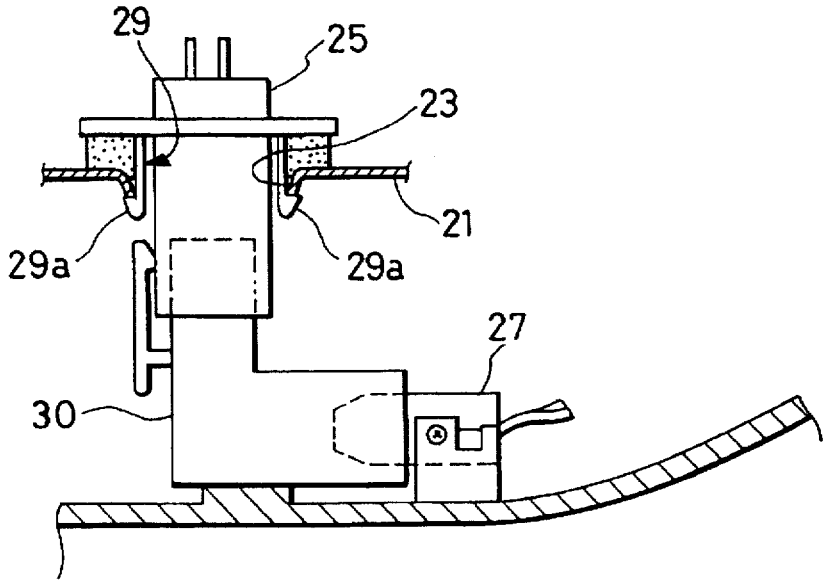
FIG.13 PRIOR ART
FIG. 13 is a side view illustrating a conventional movable connector.
Figure 14:
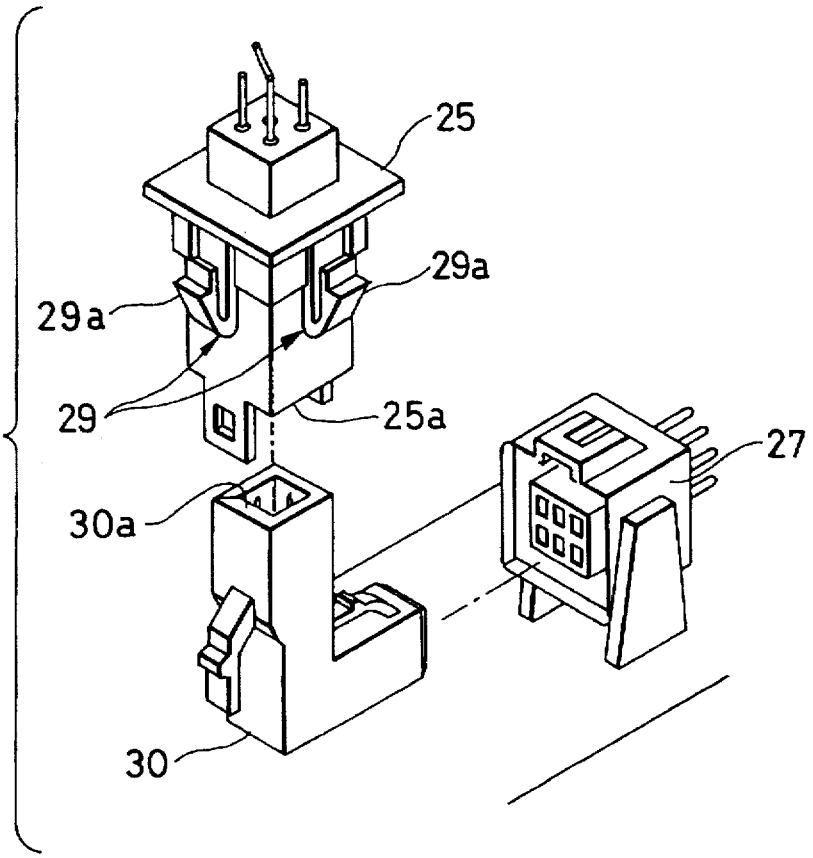
FIG.14 PRIOR ART
FIG. 14 is an exploded perspective view of the movable connector of FIG. 13.

FIGS. 8A and 8B are explanatory views illustrating a guide state where the fitting-paired-side connector has a positional misregistration relative to the movable connector on the rib in a plane perpendicular to the fitting direction, FIG. 9 is a perspective view illustrating a movable connector in which any rib is not formed, and FIGS. 10A to 10C are explanatory views illustrating a state where the movable connector having no rib is to be fitted.

When the fitting-paired-side connector 31 in which the side guide plates 35 are shifted toward the positions facing the rib 65 is inserted onto the movable connector 51, the top ends of the side guide plates 35 contact with the rib 65.

Since the rib 65 projects to the same height as the guide projections 61, the top faces of the rib 65 and the guide projections 61 are continuous in one and the same plane. As a result, the side guide plates 35 of the fitting-partner-side connector 31 contacting with the rib 65 are made to slide on the top ends of the rib 65 and the guide projections 61 continuously so as to be guided to the outside of the guide projections 61 to make the housing 53 fit into the fitting space.

In this case, if the rib 65 connecting the guide projections 61 to each other is not formed in the movable connector 51 as shown in FIG. 9, the top ends of the side guide plates 35 come into between the guide projections 61 as shown in FIG. 10B to make it impossible to guide the movable connector 51 and the fitting-paired-side connector 31 as shown in FIG. 10C.

According to the above-mentioned fitting structure of the movable connector, the side guide plates 35 are provided on the fitting-paired-side connector 31 so as to project therefrom, the guide faces 41 are formed on the respective top ends of the side guide plates 35, and the guide projections 61 having the tapered faces **63*a* are provided in the movable connector 51. Accordingly, the guide faces 41 and the tapered faces 63*a* come into contact with each other to thereby guide the spaces 39 to the guide projections 61, so that the fitting-paired-side connector 31 having positional misregistration toward the base ends of the male terminals 33** can be guided into its normal fitting position.

In addition, since the independent and elastically displaceable front guide plate 37 is provided in the fitting-partner-side connector 31, the top ends of the side guide plates 35 and the tapered faces **63*a* come into contact with each other, so that the spaces 39 can be guided to the guide projections 61 and the fitting-paired-side connector 31 having the positional misregistration toward the top ends of the male terminals 33** can be guided into its normal fitting position.

Further, since the tapered faces **63*b* are formed in the guide projections 61 of the movable connector 51 and the side guide plates 35 are elastically displaceable, the top ends of the side guide plates 35 and the tapered faces 63*b* come into contact with each other, so that the side guide plates 35 can be guided to the outside of the housing 53, and the fitting-partner-side connector 31 having the positional misregistration in the direction perpendicular to the longitudinal direction of the male terminals 33** can be guided to its normal fitting position.

In addition, since the rib 65 connecting the top ends of the pair of guide projections 61 in one and the same plane is provided, even if the fitting-paired-side connector 31 is shifted into a position where the side guide plates 35 face the rib 65, the top ends of the side guide plates 35 come into contact with the rib 65 so that the top ends of the rib 65 and the guide projections 61 are made to slide continuously, and the side guide plates 35 are guided to the outside of the guide projections 61 to make the side guide plates 35 reach the fitting space of the housing 53 surely.

In addition, by connecting the guide projections 61 to each other through the rib 65, it is possible to improve the strength of the guide projections 61 to make it possible to reduce the size of the guide projections 61.

Further, since the rib 65 has its opposite ends connected to the guide projections 61 so as to be formed substantially into a U-shape, it is possible to protect the fitting face 59 of the housing 53 enclosed thereby.

As has been described above in detail, in the fitting structure of a movable connector according to the present invention, guide projections having tapered faces are provided in the movable connector while side guide plates and a front guide plate are provided in a fitting-partner-side connector, and guide faces are formed on the top of the front guide plate. Accordingly, the fitting-paired-side connector having a positional misregistration relative to the movable connector can be guided by the sliding between the guide faces of the side guide plates and the tapered faces of the guide projections, or between the front guide plate and the tapered faces of the guide projections, or between the top ends of the side guide plates and the tapered faces of the guide projections, so that the fitting-paired-side connection can be fitted onto the movable connector in a predetermined position. As a result, it is possible to guide the two connectors effectively in the direction to absorb positional misregistration at the beginning of the contact of the connectors, so that it is possible to improve the reliability of the function for absorbing the positional misregistration in the movable connector.

What is claimed is:

1. A fitting structure, comprising:

a first connector including:

a first housing; and a pair of guide projections formed on opposite sides of said first housing so that said guide projections extend in a fitting direction of said first connector, and top end portions of said guide projections project beyond a fitting surface of said first connector, said top end portions of said guide projections having tapered surfaces;

a second connector including:

a fitting base;

a pair of parallel side guide plates formed on said fitting base to hold the opposite sides of said first housing by opposite faces of said side guide plates when said first and second connectors are fitted to each other;

a front guide plate formed on said fitting base so as to project perpendicularly to said side guide plates, wherein when said first and second connectors are fitted to each other, said front guide plate contacts a side surface of said first housing perpendicular to the opposite sides of said first housing held by said side guide plates;

projection receiving spaces, for receiving said guide projections of said first connector, defined respectively by said fitting base, said side guide plates and said front guide plate; and guide surfaces formed on top ends of said side guide plates so as to slant toward said projection receiving slots, wherein when said second connector is about to fit to said first connector, said guide surfaces are contactable with said tapered surfaces of said guide projections.

2. The fitting structure of claim 1, further comprising a substantially U-shaped rib formed to extend between said guide projections of said first connector.

3. The fitting structure of claim 2, wherein said U-shaped rib is connected to distal end surfaces of said top end portions of said guide projections continuously in the same plane.

4. The fitting structure of claim 1, wherein said side guide plates are elastically displaceable in a front-to-back side direction.

5. The fitting structure of claim 1, wherein a top side portion of said front guide plate is divided into at least three portions by slits cut in a projecting direction of said front guide plate.

6. The fitting structure of claim 1, wherein said front guide plate is elastically displaceable in a front-to-back side direction.

7. The fitting structure of claim 1, wherein said first connector is movably attached to a fitting member in order to absorb a fitting positional misregistration relative with said second connector.

* * * * *